United States Patent [19]

Weber

[11] 4,339,634

[45] Jul. 13, 1982

[54] KEYBOARD

[75] Inventor: Eugen Weber, Hinwil, Switzerland

[73] Assignee: Obisphere Corporation Wilmington, Succursale de Collonge-Bellerive, Collonge-Bellerive, Switzerland

[21] Appl. No.: 224,167

[22] Filed: Jan. 12, 1981

[30] Foreign Application Priority Data

Feb. 7, 1980 [CH] Switzerland ..... 966/80

[51] Int. Cl.[3] ..... H01H 13/70

[52] U.S. Cl. ..... 200/5 A; 200/159 R; 200/302

[58] Field of Search ..... 200/5 R, 5 A, 5 B, 5 C, 200/5 D, 5 E, 5 EA, 5 EB, 5 F, 159 R, 159 A, 302, 304

[56] References Cited

U.S. PATENT DOCUMENTS 3,372,246 3/1968 Knuepfer ..... 200/302 X 4,059,737 11/1977 Gergaud ..... 200/5 A

*Primary Examiner*—Gene Z. Rubinson

*Assistant Examiner*—Morris Ginsburg

*Attorney, Agent, or Firm*—Werner W. Kleeman

[57] ABSTRACT

A keyboard for input of data or control signals into an electronic measuring instrument, computing device or the like including a keyboard panel, a number of push-button switch elements arranged under the keyboard panel and having manually controlled ends that extend upwards through openings in the keyboard panel, and sealing means for preventing penetration of water through the openings of the keyboard panel; for such prevention of water penetration, each of the keyboard panel openings around the upwardly extending end of the switch elements is provided with a resiliently elastic hollow capsule that projects upward from the keyboard panel; each capsule is a substantially integral body comprising a substantially hollow cylindrical neck section at the lower capsule end, an adjacent deforming section and a keying area section at the upper capsule end; the deforming section of the capsules forms an elastic shape-restoring bulge whose outer diameter is greater than the outer diameter of the associated neck section; each capsule is pressed at its neck section region radially against the inner surface of the associated substantially circular opening of said keyboard panel by an essentially rigid and substantially hollow cylindrical element so as to effectively seal each keyboard panel opening and to provide for reliable operation of the pushbutton switches.

9 Claims, 8 Drawing Figures

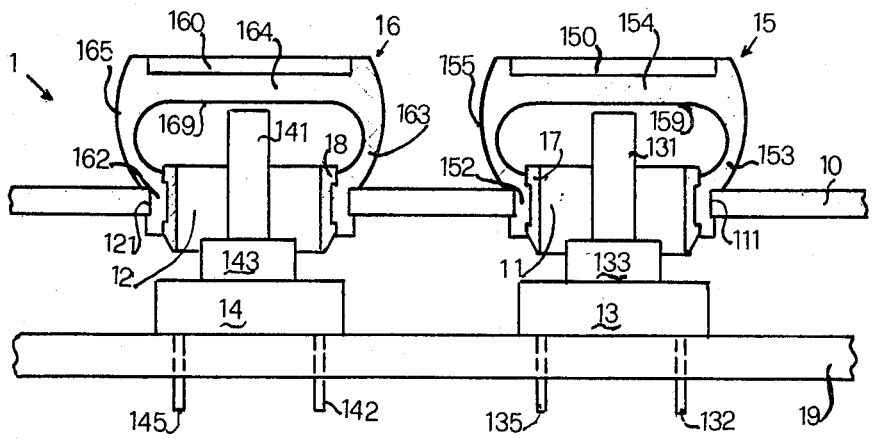
Fig. 1
Fig. 2
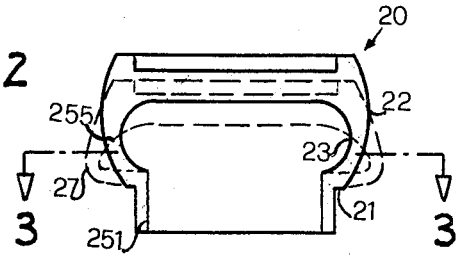
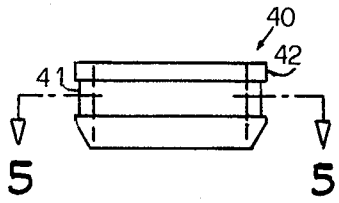
Fig. 4
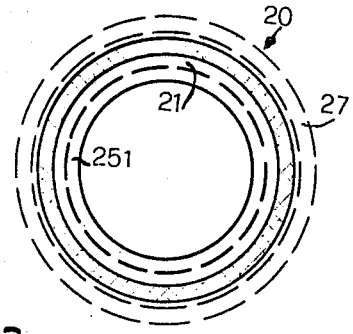
Fig. 3
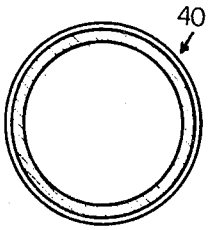
Fig. 5

KEYBOARD

CROSS-REFERENCE TO RELATED CASE

This application generally relates to subject matter disclosed in my U.S. patent application Ser. No. 871,630 filed Jan. 23, 1978, issued as U.S. Pat. No. 4,153,149 on May 8, 1979 and assigned to Orbisphere Corporation Wilmington, Succursale de Collonge-Bellerive.

BACKGROUND OF THE INVENTION

1. Field of the Invention

The invention relates to a keyboard for electronic measuring instruments, computing devices or the like.

2. Description of the Art

Conventional keyboards for such instruments have a keyboard panel with a number of openings or perforations. Beneath the keyboard panel pushbutton switch elements for actuation by manual pressure are arranged whose manually controlled ends (e.g. in the form of pushbuttons) extend upwards through openings in the keyboard panel, i.e. towards the user.

To avoid permeation of moisture or water into the electrical parts of the keyboard switches and into any circuit portions associated therewith, it is known to use either capacitive switches or to provide for sealing means that prevent passage of moisture or water through the openings of the keyboard panel. Capacitive switches are relatively expensive and/or require much space. Use of sealing means for the keyboard panel is similarly problematic; thus, it is known, for example, to pocket calculators to integrally cover the keyboard with a transparent flexible film or sheet (e.g. of plastic) sealingly fastened at the panel edges. The film or sheet can be provided with a number of protuberances corresponding to the buttons projecting from the keyboard.

A disadvantage of such arrangements is the fact that the film or flexible sheet has to be transparent or else the user cannot read the button designations; alternatively, different markings on the bulges of the covering sheet corresponding to the button designation are needed causing very high tooling and production expenditures so as to be suitable—if at all—for mass production items only.

However, various electronic measuring and/or computing devices that do include, or should conveniently include, a keyboard, such as mobile or stationary monitors for environmental control (air pollution, oxygen content of water in rivers or effluents) are no mass production items but produced in relatively small series and, up to now, no water-proof keyboards have been available that provide for simple and safe operation of such monitors in continuous use and can be produced at reasonable costs even in limited numbers.

It is an object of this invention to provide for such a keyboard having pushbutton switches, i.e. electrical and generally monostable switches requiring a mechanical force of the type exerted by finger pressure for operation, said keyboard having an improved sealing means.

A further object of the invention is to effectively prevent permeation of water through the openings of a keyboard panel. Another object of the invention is a sealed keyboard capable of being manufactured at reasonable costs even if produced in small to medium production series and providing for reliable keyboard operation even under severe weather conditions, e.g. when operated with gloved hands.

Further objects will become apparent as the specification proceeds.

SUMMARY OF THE INVENTION

These objects are achieved according to the invention by providing each of the said openings of said keyboard panel (briefly referred to as "panel" hereinafter) with an insert or sealing member in the form of a resiliently elastic and preferably integral cap member (referred to as a "capsule" or "hollow capsule" hereinafter); each capsule projects upwards from the panel, i.e. away from the switches and towards the operator, and comprises: a substantially hollow collar or neck section at the lower capsule end; a deforming section adjacent said collar; and a keying-area section at the upper capsule end. The capsule is made, for example, of a vulcanized rubber composition and the deforming section of the capsule constitutes an elastic shape-restoring outward bulge whose outer diameter is greater than that of the associated neck section; a portion of the neck or collar section of each capsule is pressed radially against the wall or inner surface of the corresponding and substantially circular opening in the keyboard panel by a rigid and substantially hollow cylindrical element made, for example, of a synthetic plastic or metal material. The capsules are open-ended and preferably monolithic structures made of an elastomeric material such as vulcanized rubber, preferably having a shore hardness of at least 50 shore units, e.g. 50 to 60 shore units.

In general, the substantially hollow cylindrical elements or securing inserts have an axial length greater than the thickness of the keyboard panel and the difference between the greatest outer diameter of the inserts and the inner diameter of the circular openings in the panel is preferably smaller than the wall thickness of the collar of the capsule. Preferably, the outer surface of each insert is provided with a groove or annular groove having a width that is at least as large as the thickness of the keyboard panel. The keying area sections can have a generally round shape or a polygonal shape, for example rectangular or square, and correspondingly shaped, plate-like insertions (made, for example, from a relatively rigid plastic or metal) can bear any symbols for identification of the associated pressure switch. The junction of the collar and the deforming section of each capsule preferably forms an annular outer stop face for contact with the outer surface of the keyboard panel and to determine the intended position of the capsule relative to the panel, e.g. when assembling the keyboard.

The deforming section of the capsule is axially symmetric and preferably toroidal, i.e. has an outer shape similar to that of an automobile tire. A non-uniform wall thickness in the deforming section is particularly preferred, e.g. in the sense that both the outer surface of the deforming section as well as its inner surface are curve-shaped in an essentially circular manner and that the radius of curvature of the inner surface is smaller than the radius of curvature of the outer surface.

According to a particularly preferred embodiment of the keyboard with a so-called ergonomic feed-back of the switching operation, each pushbutton switch element requires a predetermined or critical switch force or load for manually operating the switch, e.g. in the range of from 50 to 300 grams. Furthermore, each associated capsule is structured so that the force or load (also termed "critical deformation force" of the capsule) required to compressively upset or temporarily "crush" the capsule (with reference to the axial height of the capsule between its top or keying area and the surface of the keyboard panel) by the length of the total switching length (sum of switching length of the pushbutton switch element plus distance between the switch-contacting inner capsule wall and the end of the manually controlled end of the switch) is of the same magnitude as the critical switch force or load of the associated switch element. The term "switch force" as used herein is the minimum force or load (as expressed e.g. in grams) that will be just sufficient to trigger the switching operation. Preferably, the critical force or load required to deform or compressively upset the capsule should be of the same order of magnitude as the critical switch force and, in any case, not be considerably larger (e.g. by one power of ten) than the switch force. For any given capsule material and notably for rubber mixtures, this criterion can be met most simply by minimizing the wall thickness of the deforming section of the capsule and can be optimized if required by a few and simple tests, notably with the preferred and generally toroidal structure of the deforming section.

The invention further includes any measuring instruments and/or computing devices included within a sealed or waterproof housing and having a keyboard panel of the type disclosed herein as an integral part of the housing or in sealing or waterproof connection with such housing.

BRIEF DESCRIPTION OF THE DRAWINGS

The present invention is illustrated by way of example and not limitation in the accompanying drawings in which FIG. 1 is a fragmentary and partly sectional view of a keyboard according to the invention;

FIG. 2 is a sectional view of a capsule in its normal position and in a compressively upset or temporarily "crushed" state;

FIG. 3 is a sectional view along 3—3 of FIG. 2;

FIG. 4 is a side-view of a rigid hollow-cylindrical element;

FIG. 5 is a sectional view along 5—5 of FIG. 4;

DESCRIPTION OF THE PREFERRED EMBODIMENTS

Figure 7:
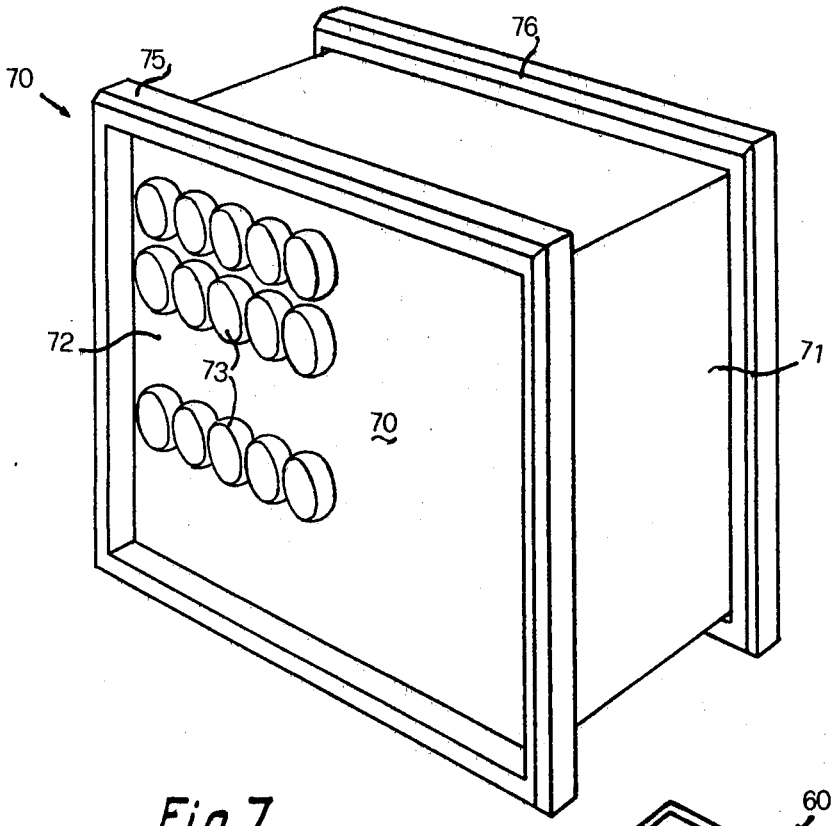
FIG. 7 is a semi-diagrammatic illustration of an electronic instrument with keyboard.

FIG. 1 shows a somewhat enlarged sectional view of a broken-off portion of a keyboard 1. Keyboard panel 10 is provided with circular openings 11, 12, and parts 131, 141 for manual operation of pushbutton switch elements 13, 14 supported by print-plate 19 extend upwards through the openings 11, 12 of the keyboard panel 10, i.e. towards the user. Parts 131, 141 for manual switch operation are pegs, e.g. of plastic, which are inserted into corresponding openings (not shown) of movable sleeves 133, 143 of the pushbutton switches 13, 14, typically of the "micro-switch" type known per se.

Conventional and commercially available pushbutton switches may be used, for example, as switches 13, 14 which, in general, are monostable switches for temporarily bridging a break or gap between conductors 132, 135 and 142, 145. When applying a gradually increasing force or load onto the upper ends of the pegs 131, 141 in a generally vertical downward direction, the associated switch 13, 14 will suddenly snap into the "on-position" if the critical switch force in the range of from 50 to 250 grams is exceeded. The switch will remain in this position only as long as at least the critical switch force continues to be applied. If the applied force is discontinued or decreased below the critical switch force, the associated switch 13, 14 snaps back into its original stable position by the impact of a spring (not shown) in the switch. The path length of such oscillating movement upon switch operation is typically about 1 mm and the actual switching function is generally accompanied by a "click-signal" that is perceptible by a tactile and, possibly, acoustic sensation on the part of the operator to produce what is termed an "ergonomic" signal to the operator.

Substantially integral or monolithic open-ended hollow capsules 15, 16 of an elastomeric material, e.g. vulcanized rubber, are inserted into openings 11, 12 of keyboard panel 10. The lower open end of each capsule 15, 16 is formed by a collar-type segment, generally a substantially hollow cylindrical neck section 152, 162. That collar or neck section is pressed against the wall, i.e. the inner surface 111, 121 of the openings 11, 12 of the keyboard panel 10, by a substantially rigid and generally hollow cylindrical element or annular insert 17, 18 so that the interposed neck section 152, 162 of each capsules 15, 16 is deformed for sealing engagement.

The annular inserts 17, 18 are substantially rigid when in operative or sealing position and are made, for example, of a relatively rigid polymer material such as a polyacetal or polyamide, or of a metal such as aluminum or brass. Their axial length is greater, e.g. two or three times greater, than the thickness of panel 10 and their outer surface is provided with an annular groove having approximately the same width, or being somewhat wider, than the thickness of panel 10. The outer diameter of each annular insert 17, 18 depends upon the inner diameter of panel 10 so that the difference between these diameters is somewhat smaller than the wall thickness of press-sealing parts 152, 162 of the capsules. As a consequence, each capsule is held in sealing engagement with panel 10 by means of the radially-acting pressure of inserts 17, 18 towards the inner surfaces 111, 121 of circular openings 11, 12. Inserts 17, 18 can, in general, be mounted manually when assembling the panel and be withdrawn, for example, when exchanging a capsule once panel 10 is removed from the switches.

The capsule collar or neck section 152, 162 is connected with a deforming capsule section 153, 163 having the general shape of an outwardly projecting bulge or tire ("torroid") formed by bulge portions 155, 165 that have an outer diameter greater than the outer diameter of the collar or neck sections. Advantageously, the wall thickness of the capsule in this bulge portion is somewhat reduced, as will be explained in more detail below (FIG. 2).

The upper end of each capsule constitutes the keying area section 154, 164 suitable for receiving and holding a relatively rigid marker plate 150, 160; adhesive bonding of the marker plate to the keying area of the capsule is optional.

In sum, each capsule 15, 16 is resiliently elastic, i.e. it returns into the shape shown in FIG. 1 after having been deformed under a load, or compressed, and this capacity, in essence, is the result of the elastic self-restoring ability of bulge 155, 165 in the deforming section 153, 163 of each capsule 15, 16.

For providing an ergonomic signal of the switching operation the force or load required for a capsule compression that is sufficient to cause electrical switching should be in the same order of magnitude, e.g. in the range of from 100 to 1000 grams, as the critical switch force of the associated switches 13, 14. An increased distance or gap between the switch-contacting inner surface 159, 169 of the keying area section 154, 164 and the adjacent upper end of manual actuation pegs 131, 141 of switches 13, 14 requires a correspondingly increased capsule deformation or compression. The total length of the switching path will be the sum of this distance or gap plus the length of the operating path of the switches. However, some gap length, e.g. 0.5 to 2 mm, between the end of each peg 131, 141 and the corresponding switch-contacting inner surface 159, 169 of each capsule may be advantageous for preventing unintended switch actuation.

In general, the total manual contact area of the keying section at the upper capsule end should have a size similar to that of a normal fingertip and general diameters of from 10 to 15 mm will be suitable for many purposes. The proportions represented in FIG. 1 are an illustrative example for selecting the dimensions of a suitable capsule.

The capsules can be manufactured according to conventional methods used for producing molded articles made of vulcanized rubber compositions using conventionally pigmented vulcanized compositions of the type yielding a shore-A-hardness of at least 50, e.g. 55 to 60. In general, natural or synthetic elastomeric materials can be used that meet the requirements of this parameter.

Both the shape and the dimensional proportions of the capsules may influence the capsule behaviour upon compression. FIG. 2 shows a section of capsule 20 corresponding to capsule 15, 16 at rest (continuous lines) and in a compressed form (broken lines). The outer surface 22 of the wall of deforming section 255 is shown to have a greater radius of curvature than the inner surface 23 so that the wall thickness of the capsule decreases from the junction at the neck section 251 in an upward direction to a portion of minimum wall thickness and then will increase toward the upper capsule end. The portion with minimum wall thickness lies approximately in a portion designated as "kink" 27 and kinking is the result of an increasing deformation of capsule 20; the kink portion of minimum wall thickness counteracts an increased shape-induced stiffening of the capsule that is not desirable along the switch path; such counter-action against shape-stiffening is assumed to be due to the predetermined buckling capacity of the capsule wall in the kink region.

Preferably, the deforming area 255 of capsule 20 should extend from the junction at the neck section 251 to the kink region 27. At the junction of neck section 251 with the deforming section 255 of capsule 20 a horizontal annular stop face 21 is provided which is to bear against the outer surface of keyboard panel 10 and determines the intended position of the capsule on assembly and opposes capsule displacement during use.

FIG. 3 shows a section of FIG. 2 along section line 3—3 to explain compressive upset or "crushing" of the capsule shape due to kink region 27 when in a compressed or buckled state. It has been found that the structural capsule features as well as the predetermined buckling behaviour of the capsule disclosed herein are eminently suitable to provide for functional protection of sealed or waterproof keyboards against unintended switch activation, for ergonomic feed-back of the switching operation and for avoiding damage to sensitive micro-switches due to excessive pressure on the capsules; the damage protection just mentioned seems to be due to the fact that the shape stability of the capsules is relatively high at the commencement of compression, but is low during buckling of the deforming area, and finally increases steeply when the kinked capsule wall comes to bear on the panel.

FIG. 4 shows a side-view of an insertion piece or insert 40 corresponding to inserts 17, 18 in FIG. 1. Annular holding groove 41 on outer surface 42 has the above-mentioned function of sealingly holding a capsule 15, 16 in openings 11, 12 of panel 10.

FIG. 5 shows a section along 5—5 of FIG. 4.

Figure 6:
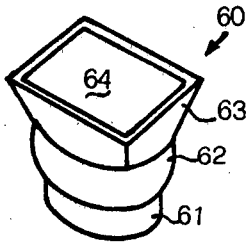
FIG. 6 is a perspective view of a modified capsule having a rectangular keying section.

FIG. 6 shows a perspective view of a modified capsule 60 whose collar 61 and deforming section 62 have a structure similar to that of capsules 15, 16, 20 having an overall rotational symmetry while the keying area section 63 at the upper end of capsule 60 is essentially rectangular.

FIG. 7 is a semi-diagrammatic or simplified perspective view of a casing or housing 70' surrounding an apparatus, e.g. an electronic control device for open-air measurement of oxygen or a weather-exposed terminal for input of data. The casing-sealed instrument 70' comprises a sealed or waterproof arrangement of a seamless sleeve portion 71 closed on both ends by a pair of plates (only front plate 70 shown in the Figure) each of which is surrounded by a frame 75, 76.

Front plate 70 is a keyboard according to the invention including a plurality of keying capsules 73 of the type shown in FIG. 1, but in a somewhat simplified presentation. Data-input or power feed lines for sealed or waterproof connection as known per se in the art have been omitted in FIG. 7 for simplification only.

Figure 8:
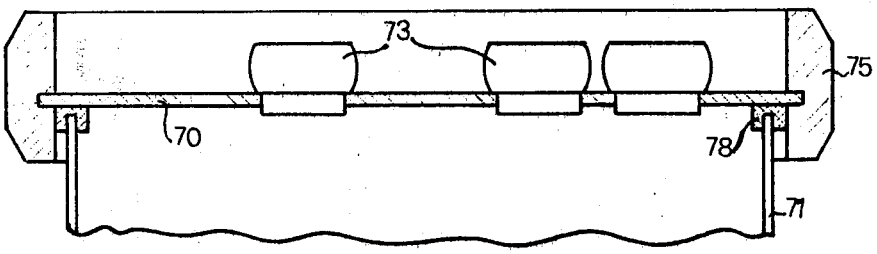
FIG. 8 is a semi-diagrammatic sectional view of a broken-away portion of the instrument shown in FIG. 7.

FIG. 8 illustrates the sealingly effective press-connection of frame 75 with keyboard panel 70 in a partially sectioned and broken-away representation indicating that panel 70, in turn, is sealingly connected with one end of sleeve 71 by means of gasket 78. Details of fastening the capsules 73 as well as the print-plate 19 (FIG. 1) with the push-button switches have been omitted for simplification.

The terms "waterproof" or "sealed" used herein with reference to the keyboard according to the invention are interchangeable and are intended to indicate that the keyboard will prevent permeation of water into housing 70 when totally submerged in water for a period of at least 24 hours.

The keyboard according to the invention is particularly suitable for electronic devices and this term is used to refer to such devices wherein the significant current is in the milliampere to microampere range and where effective exclusion of water is critical for operation of the device.

The advantages of the inventive method as well as certain changes of the disclosed embodiments will be readily apparent to those skilled in the art. It is the applicant's intention to cover by the claims all those modifications which could be made to the embodiments of the invention chosen herein for purposes of disclosure without departing from the spirit and scope of the invention.

Protection by Letters Patent of this invention in all its aspects as the same are set forth in the appended claims is sought to the broadest extent that the prior art allows.

What I claim is:

1. A keyboard suitable for input of data or control signals into an electronic measuring or computing device; said keyboard comprising a keyboard panel, a plurality of pushbutton switch elements arranged under said keyboard panel, each of said switch elements having a means for manual actuation extending from said switch element through a substantially circular opening of said keyboard panel; each of said openings of said keyboard panel being provided with a sealingly effective insert member comprising a resiliently elastic hollow capsule projecting upwards from said keyboard panel, each capsule comprising a substantially cylindrical neck section at one capsule end, an adjacently arranged deforming section and a keying area section at another capsule end; said neck section of said capsule having an outer diameter fitting into said circular opening of said keyboard panel and said deforming section of said capsule comprising an elastic shape-restoring bulge portion having an outer diameter which is greater than said outer diameter of said neck section; and an essentially rigid and substantially hollow cylindrical element arranged within said neck section of each of said capsules for radially pressing said neck section against the inner surface of said circular opening of said keyboard panel.

2. The keyboard of claim 1, wherein said substantially hollow cylindrical element has an axial length greater than the thickness of said keyboard panel, the difference between the greatest outer diameter of said element and the inner diameter of said circular opening being smaller than the wall thickness of said neck section, and said hollow cylindrical element being provided with an annular locking groove having a width that is at least as large as said thickness of said keyboard panel.

3. The keyboard of claim 1, wherein said keying area section of said capsule is provided with an insert of a substantially rigid plate member.

4. The keyboard of claim 1, wherein an annular stop face is provided at the junction of said neck section with said deforming section of each of said capsules, said stop face bearing upon the outer surface of said keyboard panel.

5. The keyboard of claim 1, wherein said deforming section of said capsule has an outwardly curved wall portion defined by a curved inner surface and a curved outer surface of said wall, the radius of curvature of said outer surface being greater than the radius of curvature of said inner surface of said deforming section so as to define a predetermined minimum wall thickness portion of said outwardly curved wall.

6. The keyboard of claim 5, wherein said minimum wall thickness portion of said outwardly curved wall is designed to form a predetermined kink of said wall upon compressive deformation of said capsule, said kink substantially limiting said compressive deformation when contacting said keyboard panel.

7. The keyboard of claim 1, wherein each said pushbutton switch element has a predetermined critical switch force and wherein the force required for compression of said capsule associated with said switch element is in the same magnitude as said critical switch force of said associated switch element.

8. The keyboard of claim 1, wherein said manual actuation means of each of said switch elements has an end portion extending into the vicinity of an inner surface portion of said capsule at said other capsule end, and wherein a predetermined gap between said end portion of said switch element and said inner surface portion of said capsule is provided for preventing unintended operation of said switch element.

9. In a measuring or computing device of the type comprising a generally sealed housing and a keyboard that includes a keyboard panel, a number of pushbutton switch elements arranged under said keyboard panel and having manually controlled ends extending upwards through openings in said keyboard panel and sealing means to prevent penetration of water through said openings of said keyboard panel, the improvement comprising providing each of said openings of said keyboard panel individually with a sealingly effective insert including a resiliently elastic hollow capsule projecting upwards from said keyboard panel, each capsule comprising a substantially hollow cylindrical neck section at the lower capsule end, an adjacently arranged deforming section and a keying area section at the upper capsule end, said deforming section of said hollow capsule comprising an elastic shape-restoring bulge portion whose outer diameter is greater than the outer diameter of the associated neck section, each hollow capsule at its neck section region being pressed radially against the inner surface of the associated and substantially circular opening of said keyboard panel by an essentially rigid and substantially hollow cylindrical element.

* * * * *